US007871193B2

(12) United States Patent
Brod et al.

(10) Patent No.: US 7,871,193 B2
(45) Date of Patent: Jan. 18, 2011

(54) MIXER HAVING A CENTRALLY DISPOSED HELICAL OR ANCHOR AGITATOR AND ECCENTRICALLY DISPOSED SCREW OR BLADE AGITATOR

(75) Inventors: Helmut Brod, Köln (DE); Stefanie Köhler, Köln (DE); Reinhold Rose, Leverkusen (DE)

(73) Assignee: Bayer Technology Services GmbH, Leverkusen (DE)

( * ) Notice: Subject to any disclaimer, the term of this patent is extended or adjusted under 35 U.S.C. 154(b) by 1038 days.

(21) Appl. No.: 11/572,146

(22) PCT Filed: Jul. 2, 2005

(86) PCT No.: PCT/EP2005/007177

§ 371 (c)(1),
(2), (4) Date: Jan. 16, 2007

(87) PCT Pub. No.: WO2006/007967

PCT Pub. Date: Jan. 26, 2006

(65) Prior Publication Data

US 2007/0237024 A1 Oct. 11, 2007

(30) Foreign Application Priority Data

Jul. 16, 2004 (DE) ..... 10 2004 034 395

(51) Int. Cl.
*B01F 7/24* (2006.01)

(52) U.S. Cl. ..... 366/97; 366/298; 366/299; 366/300; 366/301; 366/320; 422/229

(58) Field of Classification Search ..... 366/65–66, 366/96–98, 297–301, 318–324; 422/229
See application file for complete search history.

(56) References Cited

U.S. PATENT DOCUMENTS

| | | | | |
|---|---|---|---|---|
| 3,476,522 | A * | 11/1969 | Stovall | 422/135 |
| 3,482,823 | A | 12/1969 | Rechtin | |
| 4,198,376 | A | 4/1980 | Fournel et al. | |
| 5,549,384 | A * | 8/1996 | Reynolds | 366/299 |
| 6,863,432 | B2 * | 3/2005 | Schuchardt et al. | 366/299 |
| 2003/0147304 | A1 * | 8/2003 | Schuchardt et al. | 366/299 |
| 2007/0237024 | A1 * | 10/2007 | Brod et al. | 366/96 |

FOREIGN PATENT DOCUMENTS

| | | | |
|---|---|---|---|
| DE | 4117773 | | 12/1992 |
| DE | 10248333 | | 12/2003 |
| GB | 2076675 | | 12/1981 |
| SU | 1111807 | A1 * | 9/1984 |
| WO | WO 2006007967 | A1 * | 1/2006 |

OTHER PUBLICATIONS

Fluid Mixing and Gas Dispersion in Agitated Tanks, by Gary B. Tatterson, Ph.D., McGraw-Hill, Inc.: 1991, p. 325.

* cited by examiner

*Primary Examiner*—Charles E Cooley
(74) *Attorney, Agent, or Firm*—Norris McLaughlin & Marcus, P.A.

(57) ABSTRACT

A mixer having improved axial and radial mixing which retains good mixing time even during large viscosity changes, comprising a housing with at least one helical or anchor agitator located centrally in the housing in combination with at least one eccentrically arranged screw or blade agitator, preferably in mutual engagement, the combination of a helical agitator and a screw agitator enabling a much shorter mixing time as compared to a mixer having only a helical agitator without a screw agitator.

10 Claims, 8 Drawing Sheets

MIXER HAVING A CENTRALLY DISPOSED HELICAL OR ANCHOR AGITATOR AND ECCENTRICALLY DISPOSED SCREW OR BLADE AGITATOR

This is a 371 of PCT/EP2005/007177 filed 2 Jul. 2005 (international filing date).

The invention relates to a device which at least comprises a housing having at least two rotating agitators, at least one of the agitators being a helical or anchor agitator arranged centrally in the housing, and at least one of the other agitators being an eccentrically arranged screw or blade agitator.

BACKGROUND OF THE INVENTION

Helical agitators are frequently used for mixing liquids and solids. The object of the agitator is, with the lowest possible energy expenditure, to achieve the shortest possible mixing times up to homogenization of the material to be mixed. Many data on the mixing behavior of helical systems may be found in the literature [Tatterson, G. B.; Fluid mixing and gas dispersion in agitated tanks; McGraw-Hill Inc.; 1991; pp. 325ff]. Helical agitators are popular mixer geometries for homogenizing relatively high viscosity products.

The demands which are made of the mixing behavior by chemical and other production processes are constantly increasing, since decreased mixing time at the same energy input lead to reduced overall costs in production.

To increase the space-time yield in production processes, it is, furthermore, of interest to carry out as many process steps as possible in one mixing apparatus. Apparatuses having agitators must therefore be able to homogenize materials for mixing with low mixing times despite great viscosity changes. This mixing task can be fulfilled only inadequately using conventional helical agitator arrangements having one shaft. In the literature there have already been frequent descriptions that mixing times increase many times in the medium-viscosity flow range [Tatterson, G. B.; Fluid mixing and gas dispersion in agitated tanks; McGraw-Hill Inc.; 1991; page 381]. This is a great disadvantage for processes having viscosity changes which require a short mixing time at any time point for means of quality and efficiency.

DE 10248333 A1 describes mixers in which the mixing tools sweep mutually, and the container wall completely, in order to achieve self-cleaning of the mixer as completely as possible, similarly to the case with closely-meshing twin-shaft extruders. In this publication a description is likewise given that the mixing times of such self-cleaning systems are significantly decreased compared with conventional helical agitators.

The above-described mixer system, however, has the disadvantage that it can only be produced at very high cost, because the mixing tools to achieve the self cleaning, similarly to gearwheels, must be fabricated having a precise geometry matched to one another, and be driven by an exact synchromesh gear.

FR-A 94 02618 describes a further mixer having one central agitator and one eccentric agitator, the eccentric agitator fitting into a recess of the central agitator. This mixer, however, has the disadvantages that it does not generate targeted mixing in the direction parallel to the shafts, since the agitators have no axial transport action, and that the drive moment at the central shaft always passes through a high peak value when the blade of the central agitator having its recess sweeps past the blade of the eccentric agitator. This leads firstly to increased costs for the drive energy of the mixer; secondly, the high peak torque in the mutual passage of the agitators must be compensated for by a stronger construction of the agitators and of the drive, which in turn makes the entire structure more expensive.

GB 2076675A describes trough mixers having helical mixer geometry. They are widely used for mixing bulk goods or pasty media. These horizontally arranged mixers have the disadvantage that their housing must be formed in complex and thus expensive geometric shapes. In addition, it is a disadvantage that the mixers must be operated with their housing only in horizontal arrangement.

The object was therefore to provide a mixer having a cylindrical housing which has good axial and radial mixing of the material for mixing, retaining good mixing time even during large viscosity changes in the process and with low costs both for fabrication of the mixing tools and of the drive and also for the energy employed for mixing.

SUMMARY OF THE INVENTION

Surprisingly, it has now been found that a mixer comprising at least one housing (1), at least two rotating agitators (2) and (3) and also if appropriate transverse beam for fixing the agitator elements of the central rotor, at least one of the agitators (2) being a helical or anchor agitator arranged centrally in the housing (1) and at least one of the other agitators (3) being an eccentrically arranged screw or blade agitator, achieves the inventive object.

The invention therefore relates to a mixer at least comprising a housing (1), preferably comprising at least one filling and emptying orifice, at least two rotating agitators (2) and (3) and also if appropriate transverse beam for fixing the agitator elements of the central rotor, which is characterized in that at least one of the agitators (2) is a helical or anchor agitator arranged centrally in the housing (1), and at least one of the other agitators (3) is an eccentrically arranged screw or blade agitator.

DETAILED DESCRIPTION

As drive means for the agitators, use can be made of customary engines having corresponding gear machinery, one input shaft and at least two output shafts. The gear in this case produces a fixed rotary speed ratio between the two agitators. Depending on the selected pitch and diameter ratios, the rotary speed ratio of the two agitators during operation must remain constant, since, without a mechanically virtually play-free synchromesh, collision of the two agitators occurs. For mixer types where the rotary speed ratio can be selected independently of the geometry, a drive mechanism having two or more engines comes into consideration, by which rotary speeds independent of one another can be set. This produces at least one additional degree of freedom in operation of the mixer.

Helical agitators in the meaning of this publication are taken to mean mixers which are characterized by a shaft which is arranged centrally to the agitator elements and if appropriate is connected via at least one transverse beam to the agitator elements. The agitator elements of the helical agitators can be fabricated from a simple metal sheet or from hollow or solid material having a profiled cross section. They form a helix of pitch S which is arranged concentrically to the shaft. Helical agitators are here also taken to mean those structures the pitch S of which changes in a construction-specific manner with the circumference or with the angle at the circumference, as is the case, for example, for the agitators described in DE 4117773 A1.

Screw agitators in the meaning of this publication are taken to mean mixers which are characterized by a preferably centrally arranged shaft and agitator elements which are arranged helically around the shaft at the pitch S, preferably no gap, or only a small gap, being found between the agitator elements and the shaft. Screw agitators here are also taken to mean those structures the pitch S of which is not constant over the entire coil.

The terms helical agitator and screw agitator in the meaning of this publication also comprise the case that the pitch of the helix or of the screw is infinite in the mathematical sense. Then, the helical agitator is transformed into an anchor agitator and the screw agitator into a blade agitator. Anchor agitators and blade agitators in the meaning of this publication are taken to mean all technical embodiments according to the anchor geometry as described, for example, in: *Ullmann's Encyclopedia of Industrial Chemistry*, Marko Zlokarnik; Stirring; *DOI:* 10.1002/14356007.b02_25; Wiley-VCH Verlag GmbH & Co. KgaA; Release 2003, 7$^{th}$ Edition. In addition, the terms helical agitators and screw agitators are also taken to mean the fact that the helical contour of the agitator arms can also be formed by interrupted elements or elements which are mounted so as to be offset. As elements, use can be made of, for example, rods having a round cross section or triangular or rectangular cross section, or helix segments.

In a preferred embodiment of the invention, the housing has an essentially circular cross section, deviations being tolerated, for example, owing to manufacturing tolerances in the non-roundness of containers.

The bottom of the housing can have any customary shapes, such as, for example, a dished bottom, three-center arch bottom or conical tapering bottom shape. The bottom anchor shape following the helical agitator can be adapted to the bottom shape without any mixing disadvantages. The anchor shape can have an S-shape or linear shape, seen in horizontal section.

In a further preferred embodiment of the invention, the mixer has at least one orifice for filling and/or emptying. Particular preference is given to embodiments having at least in each case one filling and emptying orifice.

The inventive mixers are also characterized in that at least one eccentric agitator (3) and at least one central agitator (2) are corotating or counter rotating, very particularly preferably corotating.

In the case of the corotating agitators, further preferred embodiments apply:

Preference is given to a mixer which is characterized in that at least one eccentric screw agitator engages with the central helical agitator, that is that the outer diameter of an eccentric agitator, in a cross section perpendicular to the shafts, intersects the inner diameter of the helical agitator. The engagement E in the meaning of this publication is taken to mean the ratio of the radial intersection length (e) and the helical width (b) in a section perpendicular to the shafts. This is outlined by way of example in FIG. (2).

In a preferred embodiment, the engagement is 30 to 99%, preferably 80 to 95%.

A further relevant characteristic of the inventive mixer is the number of flights of the agitator.

The number of flights of a helical or screw agitator hereinafter is to be taken to mean the natural number which results when the angle 360° is divided by the angle by which an agitator must be rotated about its axis so that the image of its section with a plane perpendicular to the agitator shaft covers the corresponding starting section image.

Particular preference is given to mixers in which the number of flights of the anchor agitator or helical agitator is 2. This firstly has the advantage that, in the rotation of this agitator about its axis, symmetrical conditions prevail, so that scarcely any flow forces occur perpendicular to the agitator shaft. Secondly, the expenditure on fabrication for producing the agitator is still relatively low owing to the lower number of operating cycles. For the screw agitator or blade agitator, a geometry having the number of flights 1 or 2 is preferred.

In addition, the pitch of the agitator is a parameter likewise influencing the mixer. The pitch of a helical or screw agitator in this case is the ratio of coiled height and coiled circumference, when an agitator is coiled onto a plane at the outer periphery and the positions which the contact point of the agitator blade passes through with the plane is characterized by a line. The pitch of this line is then the pitch of the agitator.

In many cases, the pitch of helical and screw agitators is selected to be constant. However, there are also embodiments in which a pitch variable over the periphery is present in a construction-specific manner, such as, for example, in the case of the agitators described in DE 4117773 A1.

The pitches of the agitators are then particularly expediently matched to one another when the following mathematical relationship (I) is satisfied:

$$\frac{S_1}{S_2} = \frac{n_2 D_2}{n_1 D_1}, \text{ where} \tag{I}$$

$n_1$ and $n_2$ designate the rotary speeds, $D_1$ and $D_2$ designate the outer diameters and $S_1$ and $S_2$ designate the pitches, respectively, of the central and eccentric agitator. The pitches of the agitators should therefore behave in a manner inversely proportional to the peripheral velocities of the agitators, so that the vertical distances $x_u$ and $x_o$ between the two agitator blades in the engagement during motion remain virtually constant.

For the agitators matched in accordance with equation I, for identical vertical distances between the agitator blades $x_u = x_o$, a significant mixing time shortening in the Reynolds number region from 100 was observed compared with the configuration only having helical agitator without screw. The measured results are entered in FIG. 6 in the annex.

Surprisingly, it has further been found that with a vertical distance distribution $x_u \ll x_o$ with the direction of transport of the helical agitator in the vicinity of the vessel wall going downwards (down-pumping action), the mixing time in the Reynolds number region of 100 can be further decreased. For this shortening of the mixing time it is advantageous when the smaller distance is selected to be $x_u \ll x_o$ with the direction of flow of the helix going downwards (down-pumping action) and $x_o \ll x_u$, with the direction of flow of the helix going upwards (up-pumping action).

The pitch of the helical agitator can be between 0.05 and infinity. In a preferred embodiment of the invention, the pitch of the helical agitator is between 0.1 and 2.

The rotary speed ratio of screw agitator to helical agitator is in the range between 5:1 and 1:1. Preferably, the inventive mixer in addition has a rotary speed ratio of screw agitator to helical agitator 4:1 to 2:1, particularly preferably 3:1.

A particularly preferred structure of the mixer is obtained by reinforcing the helical agitator at the outer radius using stiffeners mounted parallel to the shaft, so that its overall construction can take up significantly greater forces and torques with low deformation. This method of construction of the helical agitator is particularly advantageous because it permits the screw agitator to engage exactly as deep into the helical agitator as without the stiffeners which leads to a particularly good mixing action of the overall mixer.

If the screw agitator does not engage into the helical agitator, the pitch directions, the pitches, the rotary speeds and directions of rotation of the agitators can be selected independently of one another.

If, however, the screw agitator engages into the helical agitator, the pitch directions and the directions of rotation of the agitator must be identical.

In a particularly preferred embodiment of the invention, the central agitator and an eccentric agitator are in mutual engagement, and the pitches of these two agitators are matched to one another in such a manner that the vertical spacing between the agitator blades in engagement during rotation of the agitators remains as constant and uniform as possible. This has the advantage that in production of the agitators and in construction of the gear for the synchromesh drive of both agitators, only relatively small requirements need to be made of the fabrication tolerances.

In a further embodiment of the inventive mixer, at least one eccentric agitator (3) and at least one central agitator counter rotate.

In the case of counter rotation, the mixers must not engage.

In addition, preferably, the mixer in the case of counter rotating mixers preferably has a number of flights for the helical or anchor agitator of 2 and the number of flights for the screw or blade agitator of 1 or 2.

In the case of counter rotating agitators, in addition, the pitch can be selected as desired, likewise the rotary speed ratio.

Likewise, a mixer having counter rotating agitators can possess stiffeners. These are then possible not only on the helix outer diameter but also on the helix inner diameter.

The housing need not be completely furnished with the inventive internals. For certain processes (degassing) for example, a gas space can be left free over the agitator internals.

The inventive mixers surprisingly demonstrated that the mixing times of these mixers compared with conventional comparable agitators (helical agitators) are significantly shortened, in particular when the screw agitator engages deeply into the helical agitator and the agitators run at a rotary speed ratio of screw agitator to helical agitator of 2:1 to 4:1, and that this good mixing action is retained even over a large viscosity range.

In the vacuum distillation of a mixture of polymer and solvent in which severe foam formation occurs, when a conventional mixer is employed, surprisingly it has been found that the foam, compared with the conventional mixer, is destroyed and reincorporated into the mixing material many times better by the inventive mixer. The inventive mixer is therefore particularly suitable for processes in which interfering foam formation occurs.

In a preferred embodiment of the invention, the inventive mixers have heating or cooling elements on the inner wall of the housing. Otherwise, the housing can also be provided per se with the known customary cooling or heating units, for example with a jacket through which heat carriers can flow, electrical heating coils etc.

The inventive mixer is suitable for any desired mixing tasks in chemical process engineering, obviously also as a reactor for stirred reactions.

The mixer, in addition to the above principally described operation with vertically arranged shafts, can also be operated as a horizontal mixer, that is with horizontally arranged shafts. A horizontal arrangement of the shafts is, for example, expedient for processes having bulk goods or moist bulk goods. In addition, of course all other angles of inclination of the shafts to the vertical between 0 and 90° are possible.

The invention will be described in more detail below with reference to the figures by way of example.

BRIEF DESCRIPTION OF THE DRAWINGS

In the drawings

FIG. 6 compares mixing time vs. rotation speed for

- a helical agitator without screw,
- a helical agitator with an engaged screw, wherein $x_u$ (the distance between a blade of the eccentric agitator and blade below it of the engaged screw agitator) and $x_0$ (the distance between the same blade of the eccentric agitator and a blade above it of the engaged screw agitator) are equal, and
- a helical agitator with engaged screw wherein $x_u$ is much lower than $x_0$.

EXAMPLES

The examples hereinafter serve to illustrate the invention without limiting it in any way.

Example 1

Figure 1A:
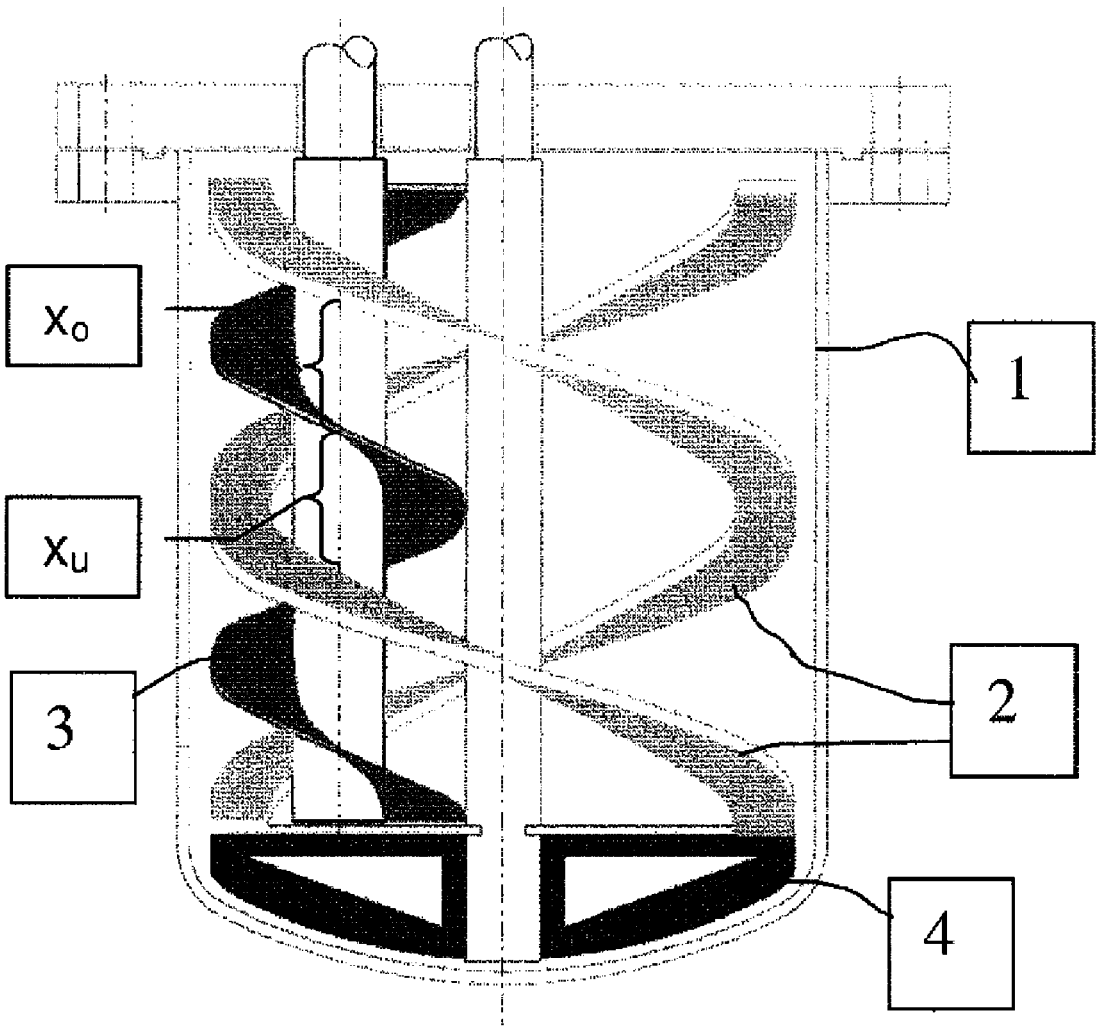
FIG. 1*a* shows the front view of an inventive mixer; the housing (1) is shown cut away.
Figure 1B:
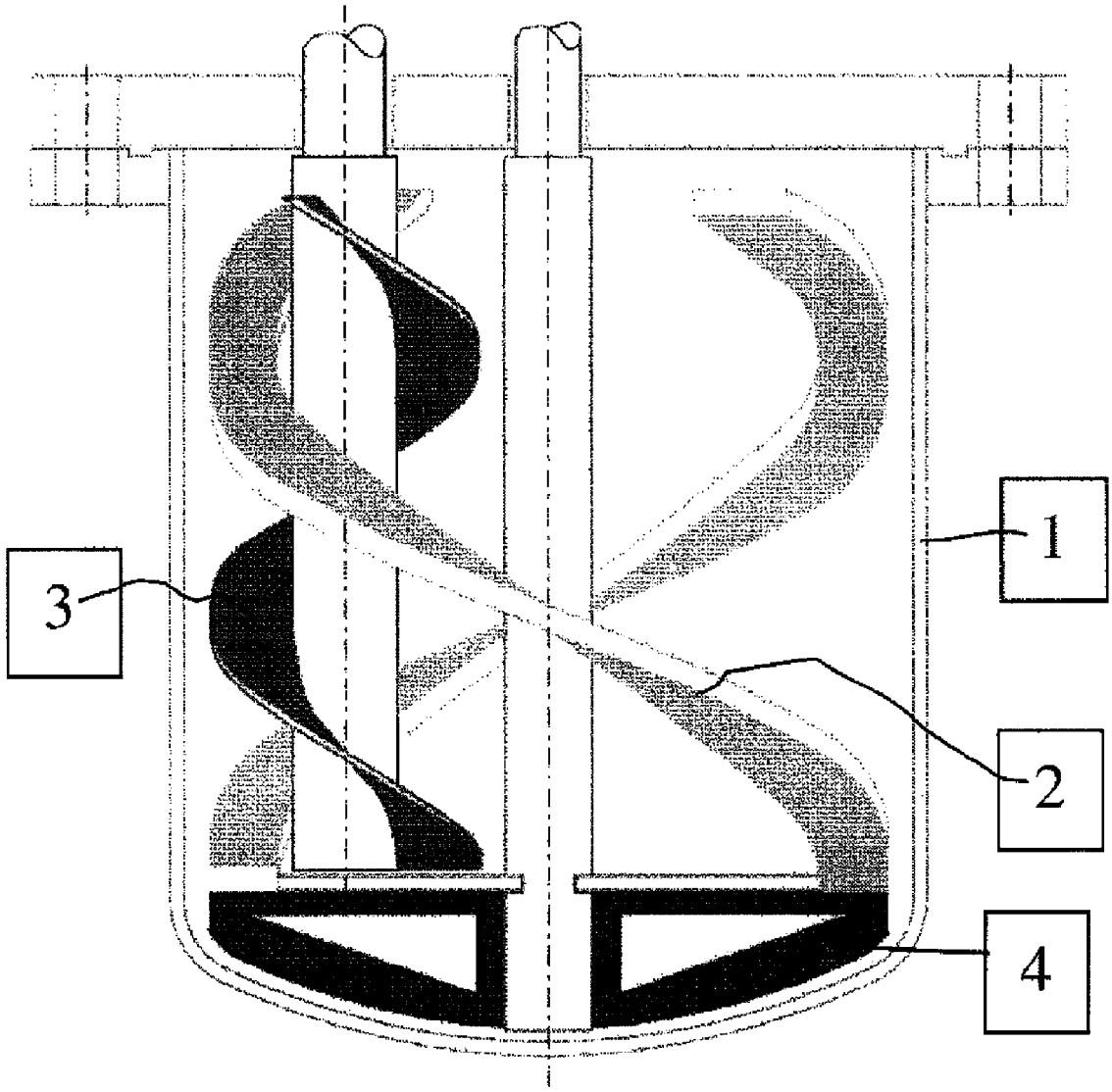
FIG. 1*b* shows the front view of an inventive mixer having pitches, enlarged compared with FIG. 1*a*, of helical and screw agitator, the housing is in turn shown cut away.
Figure 1C:
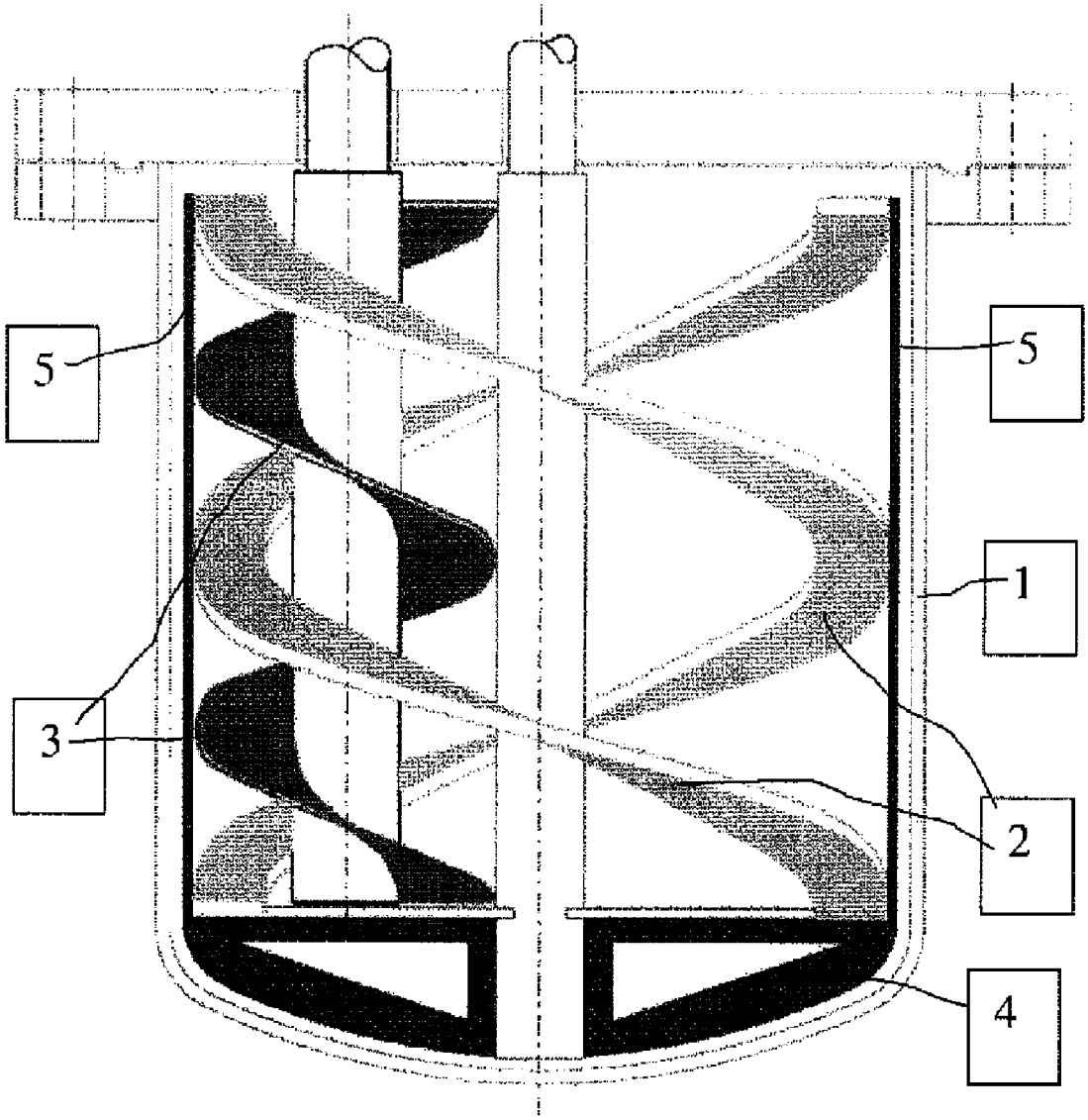
FIG. 1*c* shows the front view of an inventive mixer having pitches elevated compared with FIG. 1*a* in which reinforcing rods (5) are mounted on the outer diameter of the helical agitator (2). The housing (1) is again shown cut away.

FIGS. 1*a*, 1*b* and 1*c* show inventive mixers in side view in different embodiments.

The cylindrical housing (1), the central helical agitator (2) and the eccentric screw agitator (3) are shown. FIGS. 1*a*, 1*b* and 1*c* show by way of example the embodiment having a transverse beam (4) at the end of the central shaft to which the helixes are fixed. FIG. 1*c* additionally shows further the reinforcement rods (5) mounted in parallel to the shaft.

Since the helical and blade agitator engage, both the direction of rotation and the pitch direction of both agitators must be identical. Synchronous drive for both agitators is also necessary which ensures that the two agitators move at a fixed rotary speed ratio and the agitator blades do not come into contact with one another.

Example 2

Figure 2:
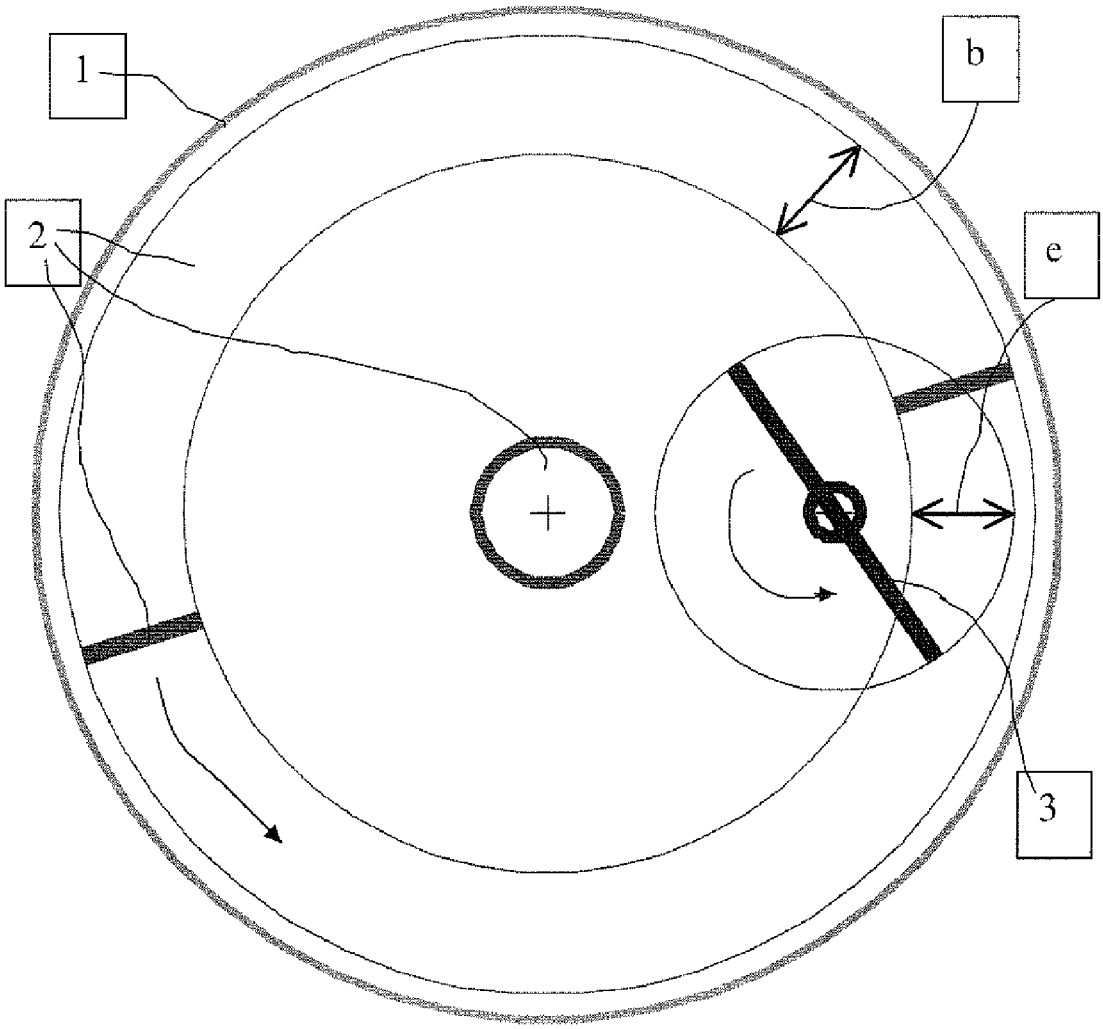
FIG. 2 shows a section through an inventive mixer having the number of flights two for the helix (2) and the number of flights two for the screw (3). The figure also shows the engagement depth (e) and the helix width (b) from which the percentage engagement E is calculated.

FIG. 2 shows a cross section through an inventive mixer. The number of flights of the helical agitator (2) and of the blade agitator (3) is two. The mixer can be operated with a rotary speed ratio of screw agitator to helical agitator of 3:1 or 2:1. For an exact matching of the pitches for the purposes of large and secure vertical distances in the engagement between the two agitators, use is made of relationship (I). In Example 2 the outer diameter of the helix is 95% of the vessel inner diameter and the outer diameter of the screw is 37% of the vessel inner diameter. The spacing between the axes of the central and eccentric agitator is 28% of the vessel inner diameter. According to relationship (I), the ratio of the pitches of helix and screw must adopt the following values:

At a rotary speed ratio of 3:1: $S_1/S_2=3\times0.37/0.95=1.17$

At a rotary speed ratio of 2:1: $S_1/S_2=2\times0.37/0.95=0.78$

If, for example, for the central helical agitator the value $S_1=1$ for the pitch is preset, which corresponds to a pitch angle of 45°, for the eccentric screw agitator the pitch $S_2=0.85$ is selected (corresponding to a pitch angle of 40.6°) at a rotary speed ratio of 3:1 and the pitch $S_2=1.28$ (corresponding to a pitch angle of 52.1°) at a rotary speed ratio of 2:1.

Example 3

Figure 3:
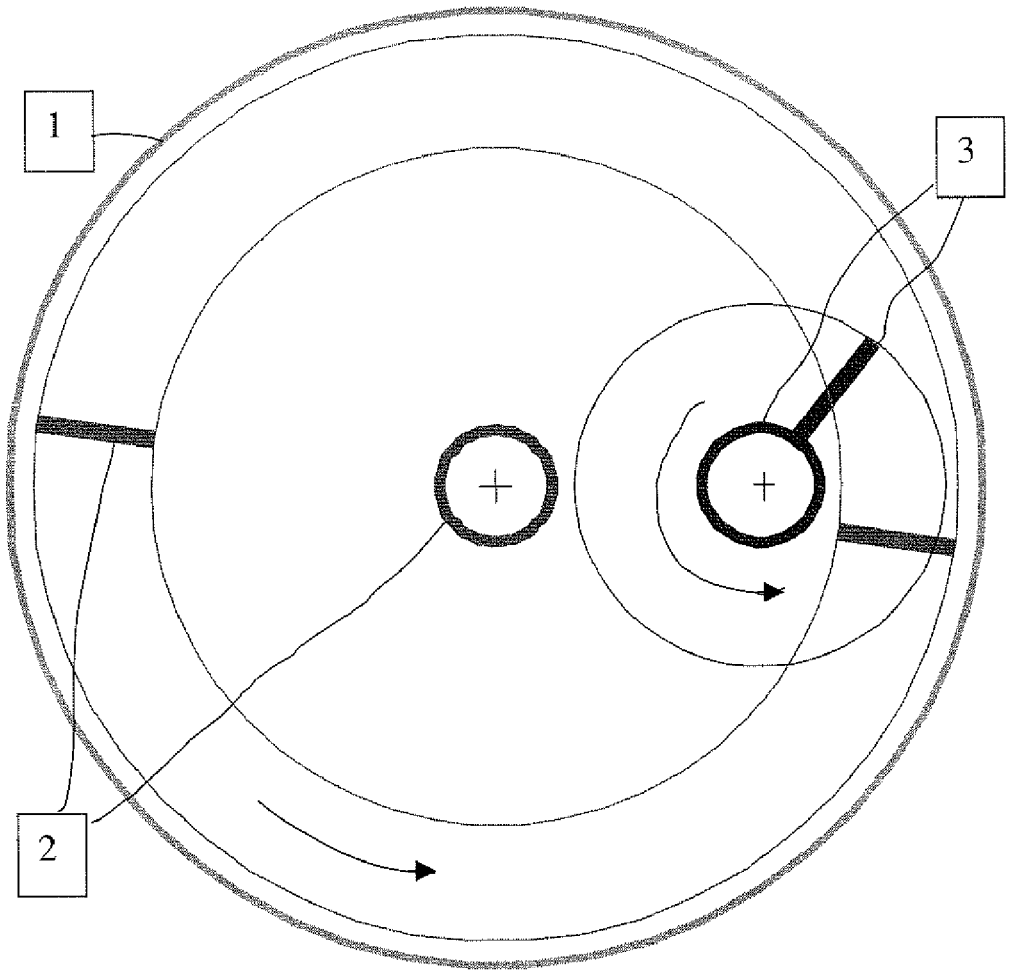
FIG. 3 shows a section through another inventive mixer in which the number of flights of the helical agitator (2) is two and the number of flights of the screw agitator (3) is one.

FIG. 3 shows shows a variant of the mixer depicted in FIG. 2 which is described in more detail in Example 2. In contrast to FIG. 2, in case of FIG. 3 the number of flights of the helical agitator (2) and of the screw agitator (3) is not equal. The number of flights of the helical agitator (2) is two and the number of flights of the screw agitator (3) is one. The engagement E is less than 100%. As described in example 2 the pitches of the agitators are then particularly expediently matched to one another when the mathematical relationship (I) is satisfied.

Example 4

Figure 4:
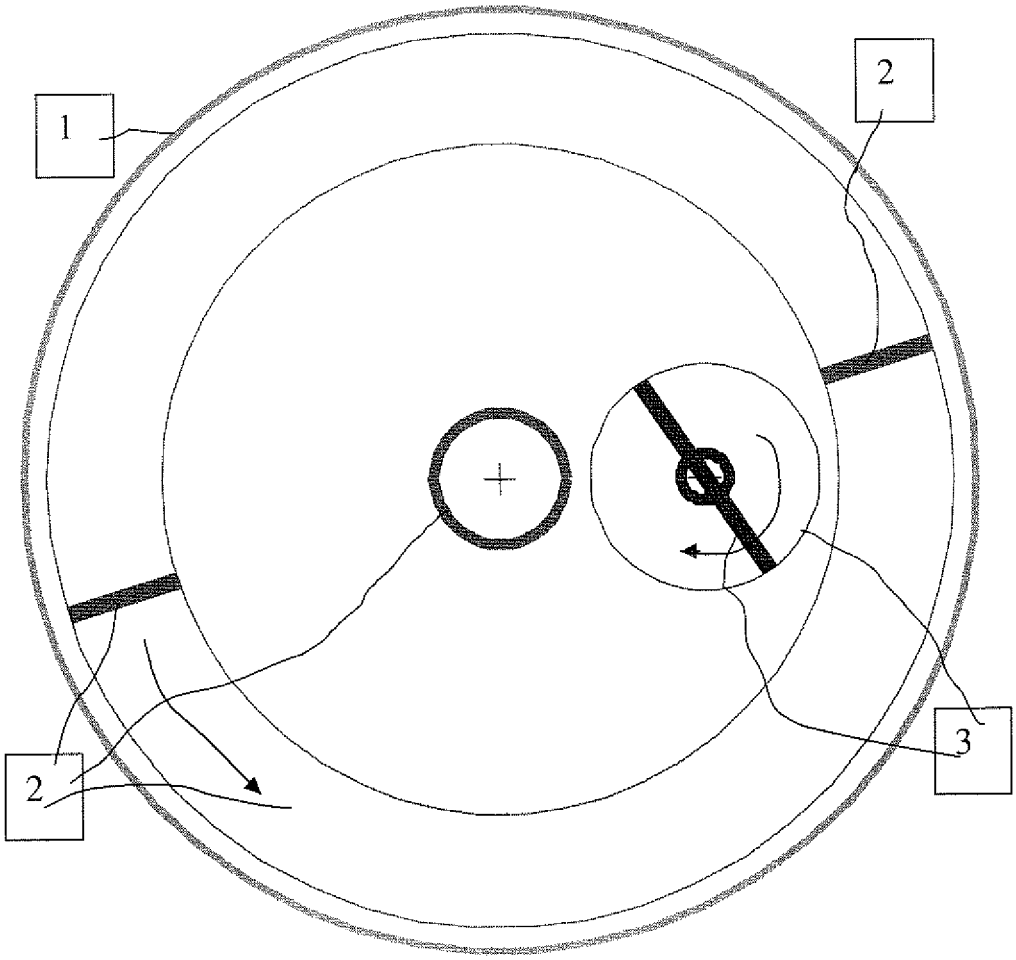
FIG. 4 shows a section through an inventive mixer in which the helix (2) and screw (3) are not engaged.

FIG. 4 shows a variant of the inventive mixer in which the central helical agitator (2) and the eccentric screw agitator (3) do not mutually engage. Both the direction of rotation and also pitch direction of both agitators can then be selected independently of one another. In addition, synchronous drive having a fixed rotary speed ratio is not necessary here. It is then possible to set the direction of transport of both agitators independently of one another in such a manner that either both agitators axially have either the same or different transport directions.

Example 5

Figure 5:
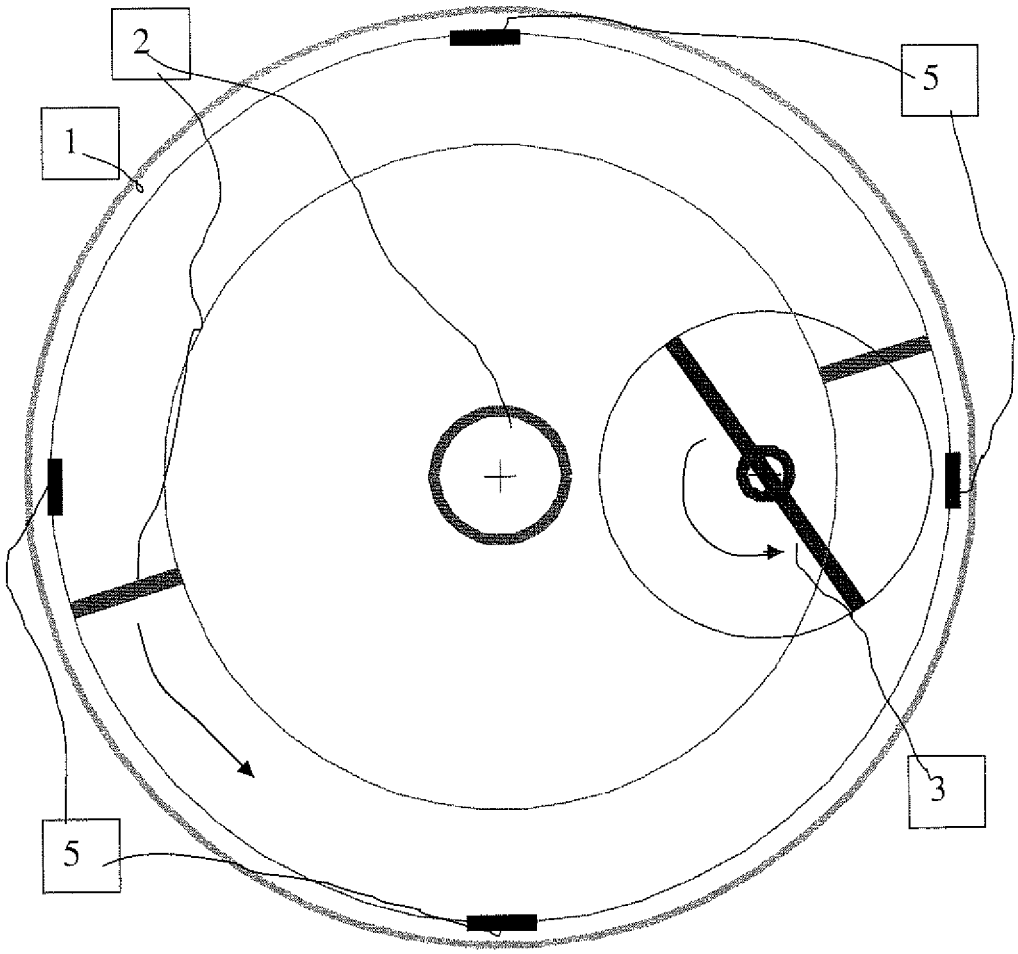
FIG. 5 shows a section through an inventive mixer in which, to improve the mechanical stability, reinforcement rods (5) are mounted parallel to the shaft on the outer diameter of the helical agitator (2).
Figure 6:
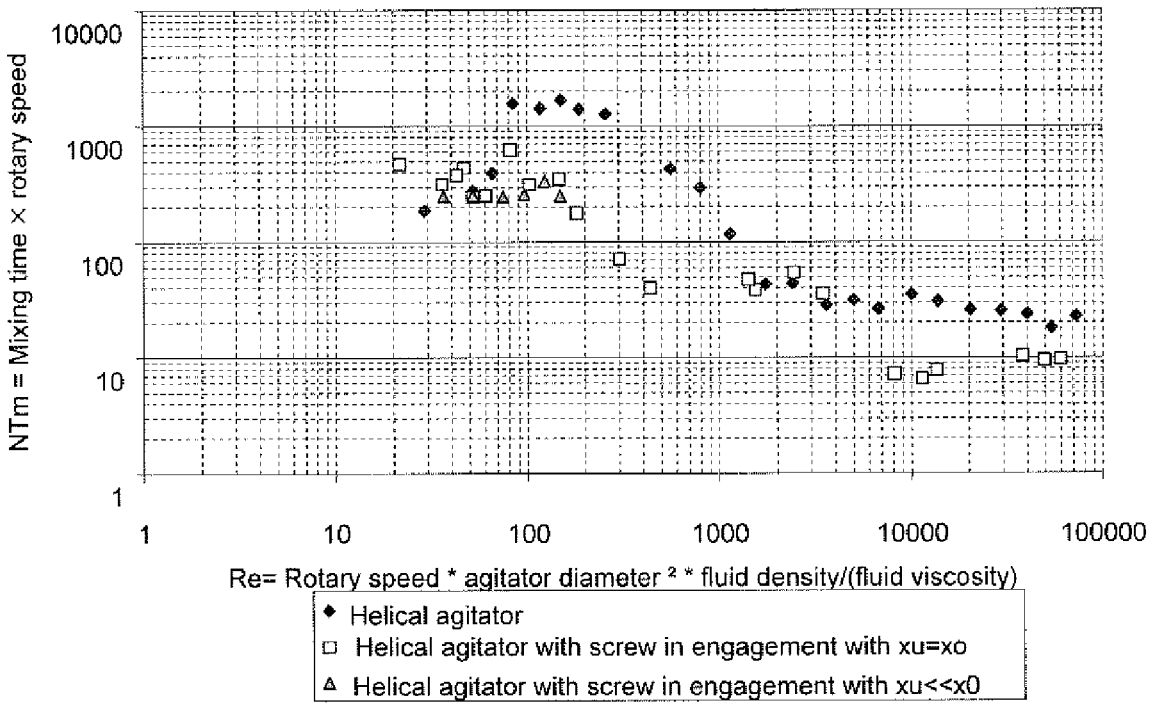

FIG. 5 shows a variant of the inventive mixer in which the central helical agitator (2) and the eccentric screw agitator (3) mutually engage and are driven synchronously. To improve the mechanical stability (in this example) four stiffening rods (5) are mounted in parallel to the shafts on the outer diameter of the helical agitator. By this means the entire structure of the helical agitator is very efficiently stiffened against elastic and plastic deformations without the engagement between the helical and screw agitator, which is important for shortening the mixing times, being hindered.

We claim:

1. A device comprising at least a housing (1), at least two rotating agitators (2) and (3), wherein at least one of the agitators (2) is a helical or anchor agitator arranged centrally in the housing (1), and at least one of the other agitators (3) is an eccentrically arranged screw or blade agitator, and wherein the pitches, the rotary speeds and the outer diameters of the agitators satisfy the following mathematical relationship (I):

$$\frac{S_1}{S_2}=\frac{n_2D_2}{n_1D_1} \quad \text{(I)}$$

where $n_1$ and $n_2$ are the rotary speeds, $D_1$ and $D_2$ are the outer diameters and $S_1$ and $S_2$ are the pitches, respectively, of the at least one central and eccentric agitator.

2. The device as claimed in claim 1, characterized in that at least one eccentric agitator (3) and at least one central agitator (2) are corotating or counter rotating.

3. The device as claimed in claim 1, wherein said centrally arranged agitator is a helical agitator and said eccentrically arranged agitator is a screw agitator, and the eccentric screw agitator engages with the central helical agitator.

4. The device as claimed in claim 3, wherein the engagement E is 30-99%.

5. The device as claimed in claim 4, wherein said engagement E is 80-95%.

6. The device as claimed in claim 1, wherein the number of flights for the helical or anchor agitator is two and the number of flights for the screw or blade agitator is one or two.

7. The device as claimed in claim 1, wherein the number of flights for the helical or anchor agitator is two and the number of flights for the screw or blade agitator is one or two.

8. The device as claimed in claim 7, wherein the central agitator is a helical agitator and the pitch S of the helical agitator is between 0.05 and infinity.

9. The device as claimed in claim 7, wherein the central agitator is a helical agitator and the eccentric agitator is a screw agitator, and the rotary speed ratio of screw agitator to helical agitator is in the range between 5:1 and 1:1.

10. The device as claimed in claim 1, wherein the vertical distance between a blade of the eccentric agitator and a blade below it of the engaged screw agitator is equal to $x_u$ and the distance between the same blade of the eccentric agitator and a blade above it of the engaged screw agitator is equal to $x_o$, wherein the relative values of $x_u$ and $x_o$ are selected so that $x_u \ll x_o$ with the direction of transport induced by the helical agitator in the vicinity of the vessel wall going downwards (down-pumping action) and $x_o \ll x_u$ with the direction of flow of the induced by the helical agitator going upwards (up-pumping action).

* * * * *